US007582225B2

(12) United States Patent
Wolfe

(10) Patent No.: US 7,582,225 B2
(45) Date of Patent: Sep. 1, 2009

(54) HIGH PERFORMANCE PHOSPHATE ESTER HYDRAULIC FLUID

(75) Inventor: Terry Calvin Wolfe, Olivette, MO (US)

(73) Assignee: Solutia, Inc., St. Louis, MO (US)

( * ) Notice: Subject to any disclaimer, the term of this patent is extended or adjusted under 35 U.S.C. 154(b) by 305 days.

(21) Appl. No.: 11/152,361

(22) Filed: Jun. 14, 2005

(65) Prior Publication Data

US 2006/0278846 A1 Dec. 14, 2006

(51) Int. Cl.
*C09K 5/00* (2006.01)

(52) U.S. Cl. ..... 252/78.5; 252/71; 252/73; 508/433

(58) Field of Classification Search ..... None
See application file for complete search history.

(56) References Cited

U.S. PATENT DOCUMENTS

| | | | |
|---|---|---|---|
| 3,679,587 | A | 7/1972 | Smith |
| 3,723,320 | A | 3/1973 | Herber et al. |
| RE37,101 | E | 3/2001 | Deetman |
| 6,319,423 | B1 | 11/2001 | Okazaki et al. |
| 6,649,080 | B2 | 11/2003 | Okazaki et al. |

*Primary Examiner*—Necholus Ogden, Jr.
(74) *Attorney, Agent, or Firm*—Husch Blackwell Sanders LLP

(57) ABSTRACT

This application discloses a high performance hydraulic fluid suitable for use as an aircraft hydraulic fluid comprising a major amount of tri(n-butyl)phosphate, a minor amount of a triaryl phosphate and optionally a minor amount of tri(isobutyl)phosphate. The compositions of this invention provide superior performance with respect to flash and fire points as well as extended useful fluid life in service. Such properties are highly valuable as hydraulic fluids modern jet aircrafts.

8 Claims, No Drawings

HIGH PERFORMANCE PHOSPHATE ESTER HYDRAULIC FLUID

This invention relates to phosphate ester functional fluid compositions and more particularly to such compositions that provide superior performance with respect to flash and fire points as well as extended useful fluid life in service.

BACKGROUND OF THE INTENTION

Most aircraft hydraulic fluids used in civilian aircraft contain some combination of phosphate esters including trialkyl phosphates, dialkyl aryl phosphate esters, alkyl diaryl phosphate esters and tri aryl phosphate esters. Such formulations are disclosed in RE 37,101 to Deetman and are said to provide superior thermal, oxidative and hydrolytic stability. A hydraulic fluid useful in aircraft is available from applicants' assignee under the trademark Skydrol® LD4. This composition typically contains 18 to 25% by weight dibutyl phenyl phosphate, 50 to 60% by weight tributyl phosphate, 4 to 8% of butyl diphenyl phosphate, 5 to 10% of viscosity index improvers, 0.13 to 1% of a diphenyldithioethane copper corrosion inhibitor, 0.005% to about 1% by weight, but preferably 0.0075% to 0.075% of a perfluoroalkylsulfonic acid salt antierosion agent, 4% to 8% by weight of an acid scavenger of the type described in U.S. Pat. No. 3,723,320 and about 1% by weight of 2,6-di-tertiary-butyl-p-cresol as an antioxidant. This composition has proved highly satisfactory in high performance aircraft application.

Since the publication of the Deetman patent, various formulations varying from the base stock disclosed by Deetman have been published to provide hydraulic fluids of varying properties. U.S. Pat. Nos. 6,319,423 and 6,649,080 to Okazaki et al. disclose variations. These base stocks contain a major amount of trialkyl phosphates wherein the alkyl portion is preferably isobutyl or isopentyl and a minor amount of triaryl phosphate. Typical base stock formulations are those containing from 30% to 45% triisobutyl phosphate, 30% to 45% tri-n-butyl phosphate and 10% to 15% triaryl phosphate. Other base stock formulation disclosed in these patents include those having 35% to 45% triisobutyl phosphate, 40% to 50% tri-n-butyl phosphate and 12% to 16% triaryl phosphate. Because of the concern for attack by hydraulic fluid degradation products on the elastomers employed in hydraulic systems seals, the Okazaki et al base stocks provide a mixture of triisobutyl phosphate and tri-n-butyl phosphate together with an amount of triaryl phosphates such that the fluid will produce no more than 25% elastomer seal swell under standard test procedures wherein the amount of triisobutyl phosphate ranges from about 35% to about 50% based on the total weight of the base stock. It is stated that such fluids have a combination of properties useful as aircraft hydraulic fluid compositions including acceptable hydrolytic stability, high flash point, good antiwear properties, acceptable erosion protection, acceptable low temperature flow properties and elastomer compatibility.

While the above noted patents indicate a high degree of effort to provide fluids useful in hydraulic aircraft fluid systems with optimum properties, the aircraft industry continually increases demands for higher requirements. Demand for overall improved properties of the hydraulic fluids is caused by ever higher performance aircraft being flown. Therefore, there is a need for even greater level of performance with regard to fluid life, (thermal stability and low temperature viscosity, while maintaining acceptable fire/flash points, auto ignition temperature as well as compatibility with materials used in aircraft hydraulic systems).

SUMMARY OF THE INVENTION

This invention is directed to phosphate ester base stock compositions and aircraft hydraulic fluid compositions containing a base stock having a novel combination of phosphate ester components.

There is provided in accordance with this invention, compositions containing a mixture of a major amount of tri(n-butyl)phosphate ester and a minor amount of a triaryl phosphate and optionally a minor amount of tri(iso-butyl) phosphate. Such compositions demonstrate improved thermal stability and low temperature viscosity.

As employed in this specification and claims the term "major amount" is an amount at least 50% but not greater than about 80%.

As employed in the specification and claims the term "minor amount" is an amount less than about 25%, of the total weight of the base stock.

As is well known in the art, many additives are employed in hydraulic fluids, particularly in those fluids employed in aircraft hydraulic systems. Such additives further enhance the properties of the fluid as compared with fluids previously available in the art for use in aircraft hydraulic systems. Typically such additives comprise about 15%, by weight, of the total weight of the fluid. Accordingly, the amount of phosphate ester components provided in the specification and claims is expressed in the percent by weight of the total amount of the final composition, including the additives commonly employed in aircraft hydraulic fluids.

Briefly, the present invention is directed to a fluid composition suitable for use as an aircraft hydraulic fluid. The composition comprises a fire resistant phosphate ester base stock, the base stock comprising between about 50% to about 80%, preferably 55% to about 65% of tri(n-butyl)phosphate, between about 5% to about 15%, preferably between about 8% to about 12% of tri(iso-propylphenyl) phosphate, and up to about 20%, preferably between about 8% to about 12% of tri(iso-butyl)phosphate with the proviso that the sum of proportionate amounts of each base stock component and additives must equal 100%.

The high performance fluids of this invention are those that meet the stringent standards of the modern passenger jets. In order to meet the needs of the latest high performance jet aircraft fluids employed in the hydraulic systems of such airplanes must have a fluid life of greater than 1000 hours in standard laboratory testing at 0.5% water and 25 ppm chlorine content at 125° C., and also a fluid life greater than 10,000 hours at 60° C. The fluid life is defined as the time required for the fluid sample to reach a Neutralization No. of 1.5 mg KOH/g sample under the procedure of ASTM D 974.

DETAILED DESCRIPTION OF THE INVENTION

A particularly preferred phosphate ester base stock of this invention is one containing about 60% tri(n-butyl)phosphate, about 10% tri(iso-propylated) aryl phosphate and about 10% tri(n-butyl) phosphate with the proviso that the sum of proportionate amounts of each base stock component together with additives must equal 100%.

As noted above, the phosphate ester base stocks of this invention contain many additives as is well known in the art to provide various beneficial properties to the fluid or aid in preventing degradation or the effects of degradation during use. Such additives are described in RE. 37,101 to Deetman, the entire disclosure of which is incorporated herein by reference.

To limit the effect of temperature on viscosity, the composition further includes a polymeric viscosity index improver. Preferably, the viscosity index improver comprises a poly (alkyl methacrylate) ester of the type described in U.S. Pat. No. 3,718,596. Generally, the viscosity index improver is of high molecular weight, having a number average molecular weight of between about 30,000 and about 150,000 and a weight average molecular weight of between about 40,000 and about 300,000. Examples of viscosity improvers include polybutylmethacrylate polymer and polyalkylmethacrylate polymer marketed under the trade names of HF411 and HF460 respectively.

An anti-erosion agent is incorporated in an amount effective to inhibit flow-induced electrochemical corrosion, more precisely referred to as zeta corrosion. The anti-erosion additive is preferably an alkali metal salt, more preferably a potassium salt of a perfluoroalkylsulfonic acid. Such anti-erosion additives are more fully described in U.S. Pat. No. 3,679,587 and can include potassium perfluoroethylcyclohexyl sulfonate.

Other additives include corrosion inhibitors such as dihydroimidazole and diphenyldithio ethane, a combination of anti-oxidants such as butylated hydroxyl toluene, 1,3,5 trimethyl-2,4,6 tris(BHT)benzene and dioctyldiphenyl amine. Still other additives include acid scavengers such as ethylhexyl-epoxycyclohexyl carboxylate and foam inhibitors such as silicone oil.

Triaryl phosphates employed in the base stocks of this invention are typically phenyl, but may also be an alkyl-substituted phenyl(alkylphenyl) wherein the alkyl substituent is $C_1$ to $C_9$, preferably $C_3$ to $C_5$. Nonlimiting examples of the aryl phosphates and alkyl substituted aryl phosphates are, for example, triphenyl phosphate, substituted phenyl phosphates such as tri(isopropylphenyl)phosphate, tri(iso-butylphenyl) phosphate, tri(tert-butyl)phosphate. Triaryl substituted phenyl substituents include tolyl (also known as methylphenyl), ethyl phenyl, isopropylphenyl, isobutylphenyl, tert-butylphenyl, and the like. Preferred triaryl phosphate esters are tri (isopropylphenyl)phosphate and tri(tert-butylphenyl)phosphate. It is also preferred that the majority of the aryl groups are substituted by only one alkyl group.

All percentages expressed in this specification and claims are percent by weight unless otherwise specified.

The following examples illustrate the invention.

Example

Hydraulic fluids having compositions set forth in Table 1 were prepared by mixing at ambient temperature in a suitable container agitated to provide adequate mixing. The phosphate ester components were introduced into the tank last. The other additives were added first in the sequence indicated in Table 1. In Table 1, "TBP" and "TIBP" refers to tri-n-butyl phosphate ester and tri-isobutyl phosphate ester, respectively. "IPTPP" refers to iso-propyltriphenyl phosphate ester. "Van Lube" refers to a commercial rust inhibitor, available from Vanderbilt as Van Lub RIG. "FC-98" refers to an antierosion agent comprising a potassium salt of perfluoroethylcyclohexy sulfonic acid, also known as perfluoroethylcyclohexylsulfonic acid. "IONOL" refers to 2,6-di-tert-butyl-p-cresol, an antioxidant, commercially available from Shell Chemical Company. "E-330" refers to 1,3,5-trimethyl-2,4,6-tris(3,5-di-tert-butyl hydroxyphenyl)benzene, an antioxidant, commercially available under the trade designation Ethanox® 330 from Ethyl Corporation. "DODPA" refers to dioctyl diphenyl amine available from Vanderbilt, "FH-132" refers to 1,2-di(phenylthio)ethane, a copper corrosion inhibitor, "MCS-1562" refers to 2-ethylhexyl epoxy cyclohexyl carboxylate, available from Dixie Chemicals, "HF411" refers to poly(butylmethacrylate) and "HF460" refers to polyalkylmethacrylate polymer in TBP, both are viscosity index improvers, "Antifoam" refers to silicone fluid available from Dow Corning Co.

TABLE 1

| Ingredients | Sample 1 | Sample 2 | Sample 3 |
|---|---|---|---|
| TBP | 61.2885 | 60.3885 | 60.3735 |
| TIBP | 10 | 10 | 10 |
| IPTPP | 10 | 10 | 10 |
| Van Lube | 0.025 | 0.025 | 0.025 |
| FC-98 | 0.025 | 0.025 | 0.04 |
| IONOL | 0.7 | 0.7 | 0.7 |
| E330 | 0.45 | 0.45 | 0.45 |
| DODPA | 0.45 | 0.45 | 0.45 |
| FH-132 | 0.5 | 0.5 | 0.5 |
| Dye | 0.001 | 0.001 | 0.001 |
| MCS-1562 | 6.2 | 6.2 | 6.2 |
| AntiFoam | 0.0005 | 0.0005 | 0.0005 |
| HF411 (35.5% solids) | 5.76 | 6.26 | 6.26 |
| HF 460 (58% solids) | 4.6 | 5 | 5 |

Tests were conducted to determine the fire safety, low temperature viscosity, pour point and specific gravity of the fluids described in Table 1. The flash and fire points were determined by means of the procedure of ASTM D-92. The compositions were then tested to determine their properties with regard to autoignition temperature (AIT) under the procedure of ASTM D-2155, viscosity, pour point and specific gravity. In Table 1, all examples are based upon 100 gram samples. The results of the tests appear below in Table 2.

TABLE 2

| TEST | Sample 1 | Sample 2 | Sample 3 |
|---|---|---|---|
| AIT ° C. | | 422.2 | 430.6 |
| Flash Point ° C. | | 185.6 | 174.4 |
| Fire Point ° C. | | 195 | 191.1 |
| Viscosity @−54° C. | 972 | 1076 | 1052 |
| Viscosity @ 37.7° C. | 8.89 | 9.28 | 9.52 |
| Viscosity @ 99° C. | 3.11 | 3.33 | 3.31 |

What is claimed is:

1. A hydraulic fluid composition suitable for use as an aircraft hydraulic fluid comprising from about 55% to about 65% tri(n-butyl)phosphate, from about 8% to about 12% triaryl phosphate and from about 8% to about 12% tri(isobutyl)phosphate.

2. A composition of claim 1 wherein the triaryl phosphate is triphenyl phosphate.

3. A composition of claim 2 wherein the aryl is an alkyl substituted aryl.

4. A composition of claim 3 wherein the aryl group is substituted by one alkyl group.

5. A composition of claim 4 wherein the alkyl substituent is selected from $C_1$ to $C_9$ alkyl groups.

6. The composition of claim 5 wherein the alkyl substituents are selected from the group consisting of methyl, ethyl, propyl, isopropyl, butyl, isobutyl, tert.-butyl, pentyl, isopentyl, hexyl, heptyl, octyl and nonyl.

7. A composition of claim 1 comprising about 60% tri(n-butyl)phosphate, about 10% of tri(iso-propylphenyl)phosphate and about 10% of tri(iso-butyl)phosphate.

8. The composition of claim 1 further including about 15% additives by weight of the final composition.

* * * * *